US012344503B2

(12) United States Patent
Malcles et al.

(10) Patent No.: US 12,344,503 B2
(45) Date of Patent: Jul. 1, 2025

(54) REEL FOR WINDING AND UNWINDING A LINK

(71) Applicant: Conductix Wampfler France, Belley (FR)

(72) Inventors: Nicolas Malcles, Belley (FR); Hervé Savarino, Bregnier-Cordon (FR)

(73) Assignee: Conductix Wampfler France, Belley (FR)

( * ) Notice: Subject to any disclaimer, the term of this patent is extended or adjusted under 35 U.S.C. 154(b) by 706 days.

(21) Appl. No.: 17/620,840

(22) PCT Filed: Jul. 1, 2020

(86) PCT No.: PCT/EP2020/068546

§ 371 (c)(1),
(2) Date: Oct. 13, 2022

(87) PCT Pub. No.: WO2021/001436

PCT Pub. Date: Jan. 7, 2021

(65) Prior Publication Data

US 2023/0211976 A1 Jul. 6, 2023

(30) Foreign Application Priority Data

Jul. 1, 2019 (FR) ..... 1907258

(51) Int. Cl.
*B65H 75/14* (2006.01)
*B65H 75/50* (2006.01)

(52) U.S. Cl.
CPC ..... *B65H 75/14* (2013.01); *B65H 75/50* (2013.01); *B65H 2701/30* (2013.01); *B65H 2701/5114* (2013.01); *B65H 2701/51344* (2013.01)

(58) Field of Classification Search
CPC ..... B65H 75/14; B65H 75/18; B65H 75/50; B65H 2701/5114
See application file for complete search history.

(56) References Cited

U.S. PATENT DOCUMENTS 5,921,499 A 7/1999 Forsner
9,038,272 B1 * 5/2015 Rankin, VI ..... F03G 1/00 29/896.9

(Continued)

FOREIGN PATENT DOCUMENTS

AU 6259673 A 5/1975
FR 1309550 A 11/1962

(Continued)

OTHER PUBLICATIONS

International Search Report dated Sep. 4, 2020 for PCT/EP2020/068546.

(Continued)

*Primary Examiner* — Sang K Kim
(74) *Attorney, Agent, or Firm* — Ryan T. Grace; Advent, LLP

(57) ABSTRACT

The invention relates to a reel for a winder, comprising:
a mandrel (10) extending around an axis of rotation (X) of the reel,
a plurality of pairs of lateral arms (20*a*, 20*b*) extending on both sides of the mandrel (10), together acting as flanks defining, between them, a winding volume for the link,
said reel being characterised in that it comprises a closed flange (40) attached to the arms (20*a*) constituting one of said flanks, said flange having a thickness of between 10 and 40 mm.

16 Claims, 7 Drawing Sheets

(56) References Cited

U.S. PATENT DOCUMENTS

| | | | | |
|---|---|---|---|---|
| 9,926,168 | B2 * | 3/2018 | Berger | B65H 75/24 |
| 2010/0025521 | A1 * | 2/2010 | Snitselaar | B65H 75/2245 242/608.2 |

FOREIGN PATENT DOCUMENTS

| | | | |
|---|---|---|---|
| FR | 2938520 | A1 | 5/2010 |
| JP | 2007055764 | A | 3/2007 |
| JP | 2016519636 | A | 7/2016 |
| WO | 9221603 | A1 | 12/1992 |
| WO | 2014167105 | A1 | 10/2014 |

OTHER PUBLICATIONS

Preliminary Search Report dated Feb. 20, 2020 for FR1907258.
Notice of Reason(s) for Rejection for Japanese Application No. 2021-576789, dated Jul. 2, 2024.

* cited by examiner

PRIOR ART

PRIOR ART

PRIOR ART

REEL FOR WINDING AND UNWINDING A LINK

FIELD OF THE INVENTION

The present invention relates to a reel making it possible to wind and unwind a link in particular for the transmission of energy and/or the transmission of data, such as a cable, a pipe, an optical fibre or other, as well as a method for manufacturing such a reel.

PRIOR ART

In particular in documents WO 2014/167105 and WO 2015/071341 in the name of the Applicant, reels are known intended for winding and unwinding a link, for example a link of the type allowing the transmission of energy and/or the transmission of data.

In reference to FIGS. 1 to 3, such a reel comprises:

- a mandrel 10 extending along an axis of rotation of the reel, and
- two sets of lateral arms 20*a*, 20*b* defining a winding volume of the link, adapted to laterally contain the turns of said link, attached on both sides of the mandrel 10. Each arm set forms a flank.

The structure of the reel is rigidified by ferrules, namely:

- an interior ferrule 30, located at a first distance from the mandrel, and
- a pair of exterior ferrules 31*a*, 31*b* wherein each ferrule is attached to at least one arm of a respective flank at a second distance from the mandrel, greater than the first distance.

The reel comprises a bearing surface adapted to receive the turns of the link, the interior turn being in contact with said bearing surface. Said bearing surface can in particular be a part of the mandrel or of the interior ferrule.

The inter-flange space, i.e. the distance between the two flanks, is defined according to the width of the link to be wound on the reel. In order to allow for correct winding/unwinding of the link, in particular in the case of a single-turn reel, the inter-flange space is adjusted so that the distances between the flanks are adapted to the link wound at the proximal and distal ends of the arms.

A current trend is to decrease the width and/or the thickness of the links, which makes it possible, for the same reel diameter, to wind a greater length of link and a greater number of turns on the bearing surface. In order to retain regular winding/unwinding of the link, which is guided by the flanks, such a reduction in the dimensions of the link entails reducing the inter-flange space.

An element limiting the reduction in the inter-flange space is the thickness of the mandrel, i.e. its dimension parallel to the axis of rotation of the reel.

Indeed, a reduction in the thickness of the mandrel results in a reduction in the rigidity of the reel, which results in an increase in the displacement amplitude of the distal ends of the arms with respect to the mandrel in particular under the effect of an axial stress, whether it be static or dynamic such as the wind.

Moreover, a substantial thickness of the mandrel makes the manufacturing thereof expensive. Indeed, for a thickness typically greater than 25 mm, the methods of cutting a sheet with a laser are not adapted and have to be replaced with methods that have technical limitations and/or are more expensive, such as oxycutting or drilling with a drill press.

BRIEF DESCRIPTION OF THE INVENTION

A purpose of the invention is to design a reel that has an improved rigidity and a reduced mass while still being manufactured at least cost.

In particular, such a reel can be adapted to receive a link of low width (for example of about 20 to 40 mm) without its rigidity being degraded with respect to known reels.

To this effect, the invention proposes a reel for the winding and unwinding of a link, comprising:

- a mandrel extending around an axis of rotation of the reel,
- a plurality of pairs of lateral arms extending on both sides of the mandrel, together acting as flanks defining between them a winding volume for the link, said reel being characterised in that it comprises a closed flange attached on each one of the arms constituting one of said flanks, said flange having a thickness of between 10 and 40 mm.

The term "closed" means that the flange has a continuous shape that closes in on itself. Considered as a cross-section in a plane orthogonal to the axis of rotation of the reel, around which it extends, the flange is therefore delimited by a closed interior contour and a closed exterior contour, the distance between the two contours being defined as the width of the flange. The flange can have an annular shape, i.e. with concentric circular interior and exterior contours, but it is not limited to this particular shape of the contours. More generally, the interior and exterior contours of the flange can include curved portions and/or straight portions.

Particularly advantageously, said flange has a thickness adapted to be cut by a laser, for example between 10 and 25 mm.

Preferably, the flange has a thickness identical to that of the mandrel.

According to an embodiment, the mandrel has a thickness between 20 and 40 mm.

According to a preferred embodiment, the external shape of the mandrel coincides with the internal shape of the flange.

The flange can have a width between 30 and 100 mm.

According to an embodiment, the flange is attached to each arm constituting one of the flanks by threaded rods or screws, each threaded rod or screw passing through an oblong hole of the flange and an oblong hole of the respective arm, said oblong holes being oriented along substantially orthogonal directions.

Another object of the invention relates to a method for the manufacturing of a reel such as described hereinabove.

Said method comprises the following steps:

(a) the supplying of the mandrel and of the flange;

(b) the attaching of the arms on both sides of the mandrel to form two flanks;

(c) the attaching of the flange on the arms constituting one of the flanks.

According to a preferred embodiment, which the step (a) comprises the cutting of the mandrel and of the flange from a same metal sheet, the flange extending around the mandrel.

Particularly advantageously, the cutting of step (a) is carried out by a laser.

BRIEF DESCRIPTION OF THE DRAWINGS

Other characteristics and advantages of the invention shall appear in the following detailed description, in reference to the accompanying drawings wherein.

DETAILED DESCRIPTION OF EMBODIMENTS OF THE INVENTION

Figure 1:
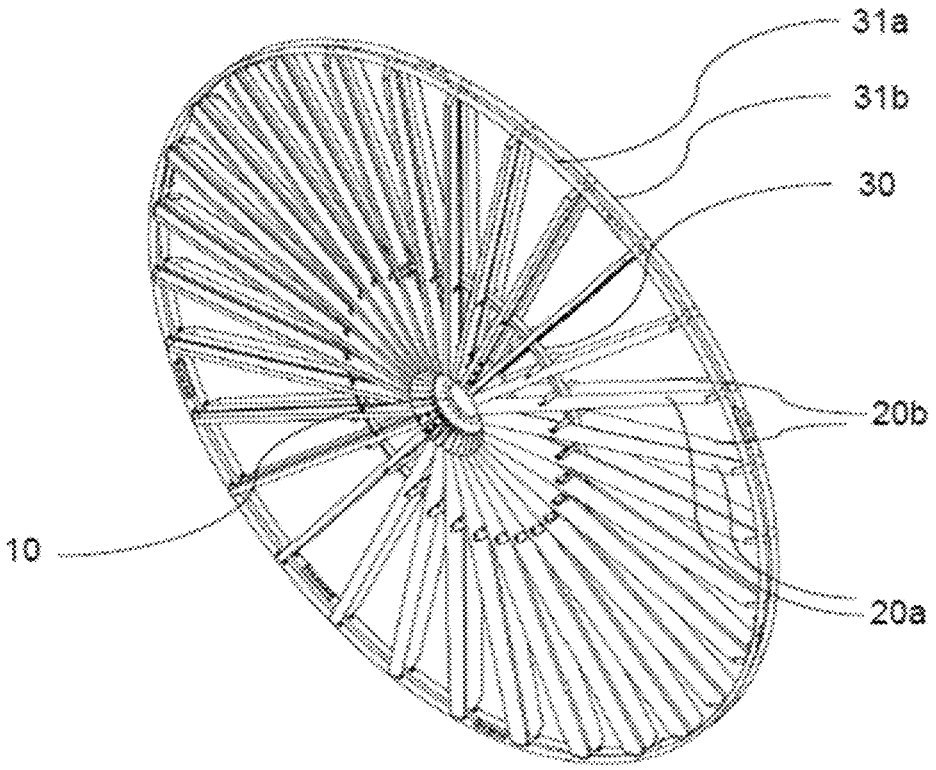
FIG. 1 is a perspective view of a known reel.
Figure 2:
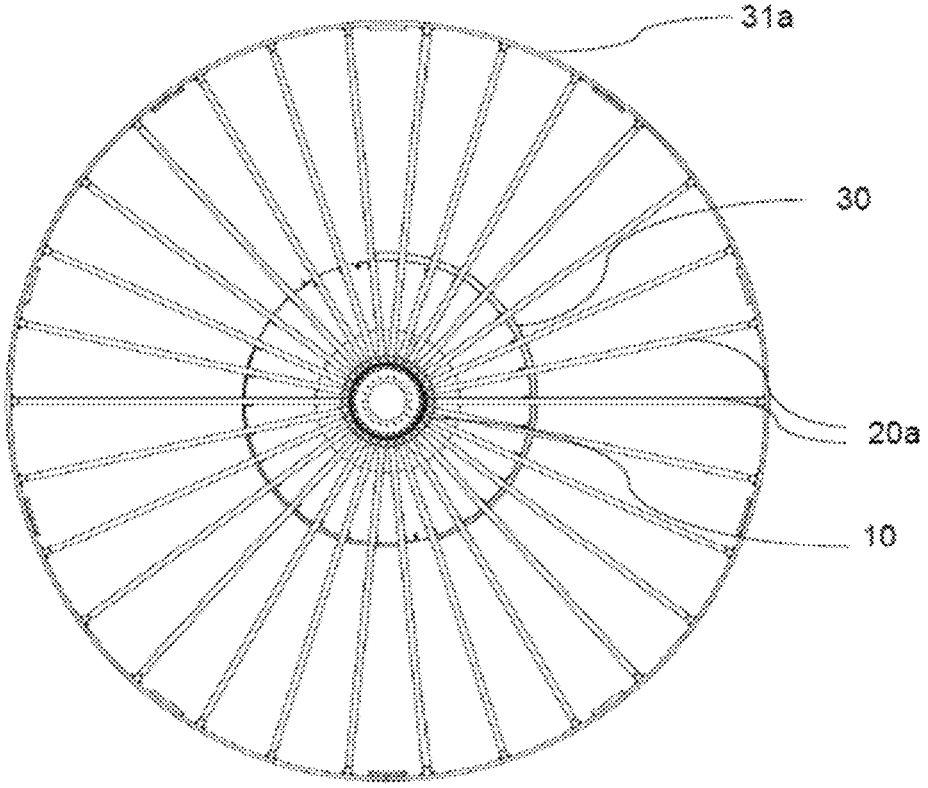
FIG. 2 is a front view of the reel of FIG. 1.
Figure 3:
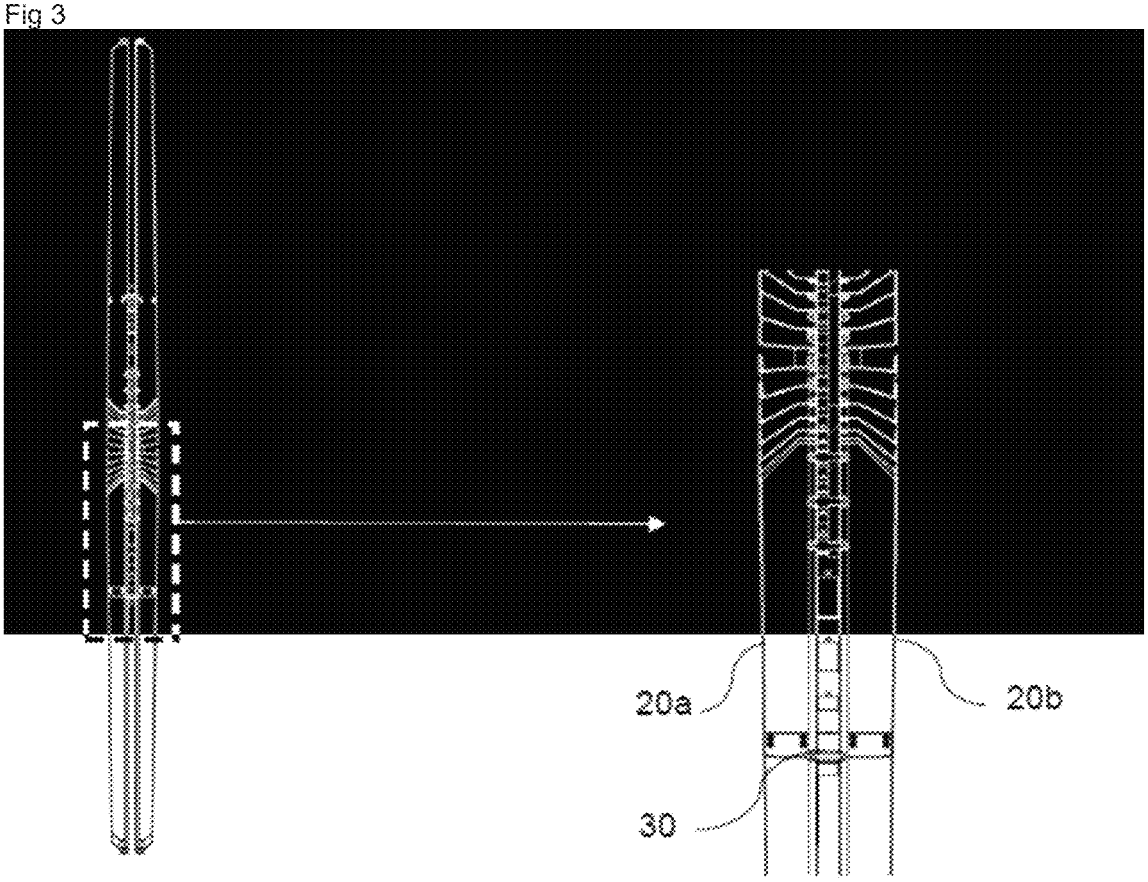
FIG. 3 is a cross-section view of the reel of FIG. 1.
Figure 4:
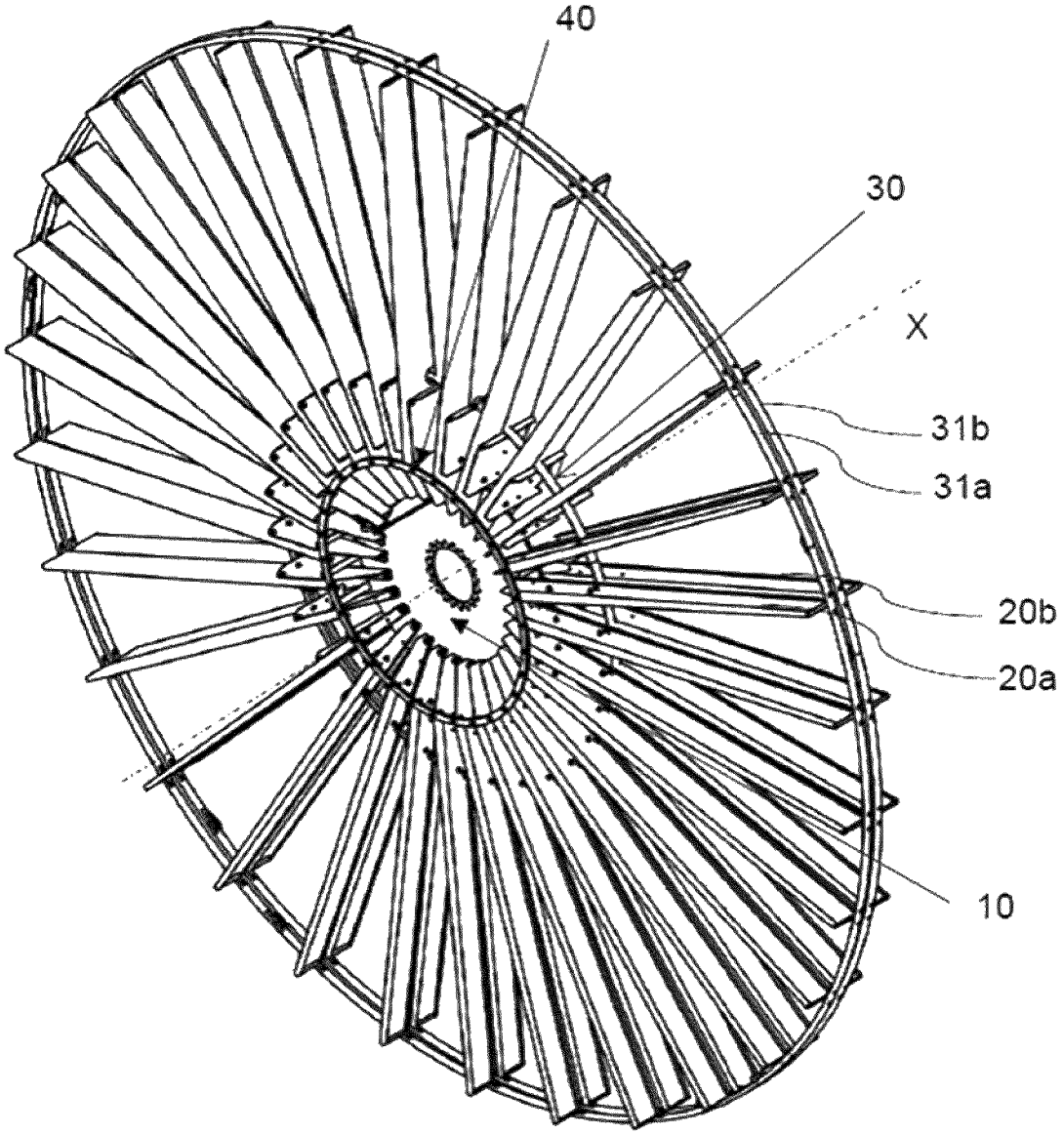
FIG. 4 is a perspective view of a reel according to an embodiment of the invention.
Figure 5:
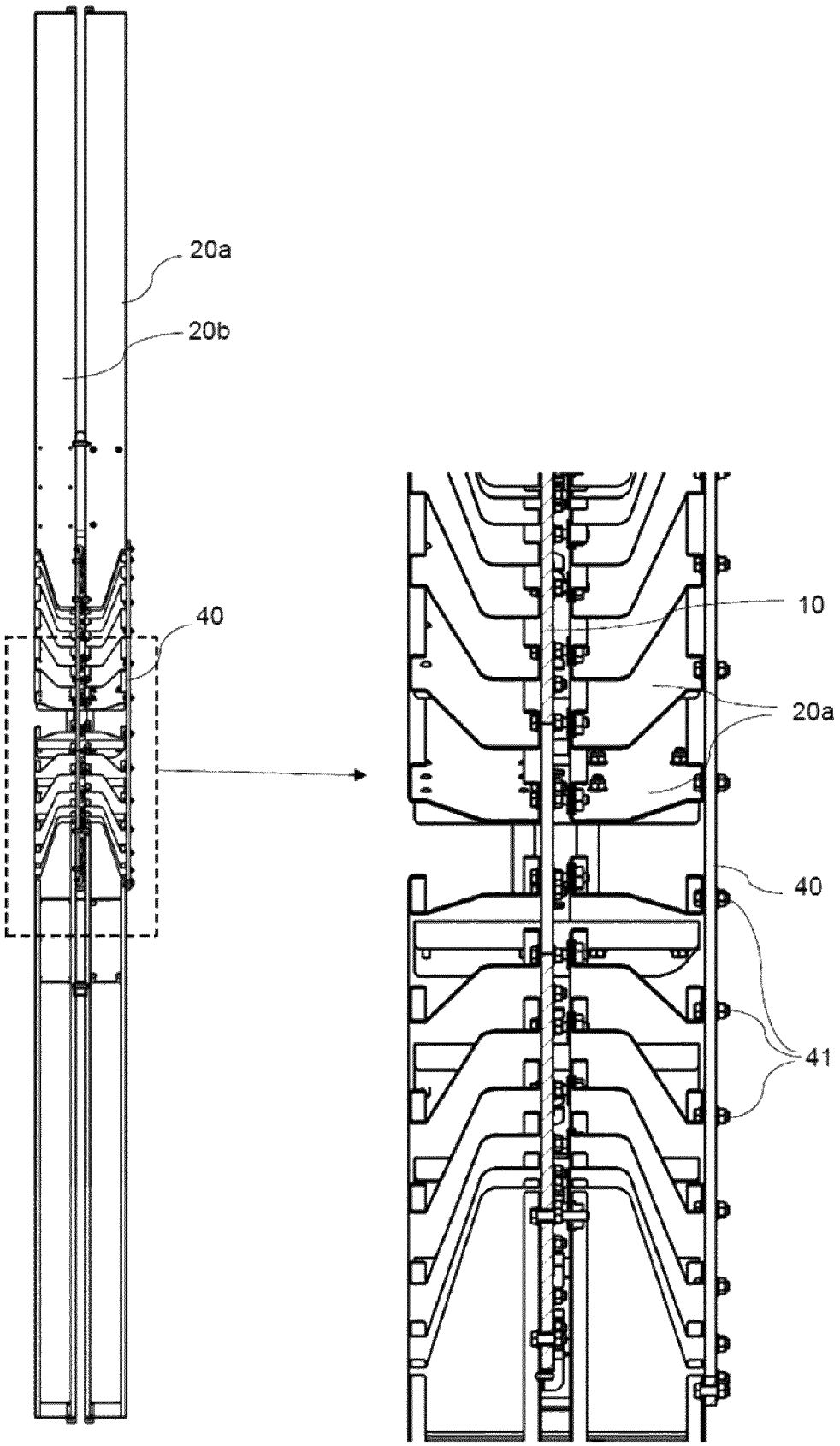
FIG. 5 is a cross-section view of the reel of FIG. 4.

In reference to FIG. 5 and following, the reel comprises a mandrel 10 extending around an axis of rotation X of the reel.

According to a preferred embodiment, the mandrel 10 has a cylindrical shape of revolution, of which the axis is coincident with the axis X. Alternatively, the external shape of the mandrel can be constituted of a plurality of facets, each one extending in a plane parallel to the axis X; preferably, the different facets are all located at an equal distance from the axis X.

The mandrel 10 has two opposite faces orthogonal to the axis X.

The mandrel is typically cut out of a metal sheet.

The thickness of the mandrel, i.e. the distance between the two opposite faces, is typically between 20 and 40 mm.

In a manner known per se, the reel further comprises two flanks that extend on both sides of the mandrel. The flanks define between them a winding volume of the link, adapted to laterally contain the turns of said link. The inter-flange space is defined according to the width of the link to be wound on the reel. More precisely, in the case of a single-turn reel, the inter-flange space is slightly greater than the width of the link to take into account the dimensional tolerances related to the manufacturing of the link; in the case of a multi-turn reel, intended to receive several adjacent turns, the inter-flange space is slightly greater than the sum of the widths of the adjacent links. Thus, the flanks guide the winding and the unwinding of the link.

Each flank is constituted by a set of lateral arms 20*a* or 20*b* that extend radially from the mandrel. The proximal portion of each arm is rigidly integral with a respective face of the mandrel, for example by means of threaded rods. In practice, the arms forming one of the flanks can be directly attached to a face of the mandrel, while the arms of the other flank can be attached at a determined distance from the opposite face of the mandrel in order to obtain the desired inter-flange space. This distance can in particular be adjusted by means of a device for adjusting the inter-flange space such as described in document WO 2014/167105.

Each flank is planar i.e. the faces of the arms opposite the mandrel are coplanar, and extend in a plane orthogonal to the axis X of rotation of the mandrel.

In the present text, the terms "proximal" and "distal" designate an element that is relatively close to or far from the mandrel.

The arms are for example formed by folding a metal sheet or can come from metal profiles.

The link can have a round section (in which case the width and the thickness of the link are equal to its diameter), which is in particular the case for multi-turn reels, substantially rectangular (in which case the width of the link is the dimension that extends along the axis X and the thickness is the dimension perpendicular to the width), or any other section depending on the target application.

The structure of the reel is rigidified by ferrules, namely:

an interior ferrule 30, located at a first distance from the mandrel, and a pair of exterior ferrules 31*a*, 31*b* wherein each ferrule is attached to an arm of a respective flank at a second distance from the mandrel, greater than the first distance. For example, the exterior ferrules can be attached at the distal end of the arms.

Each ferrule can be constituted of a single piece or of a plurality of portions each extending along an angular sector about the axis X.

According to an advantageous embodiment, each ferrule can comprise a removable portion, such as described in document WO 2015/071341.

The reel comprises a bearing surface adapted to receive the turns of the link, the interior turn being in contact with said bearing surface. The bearing surface generally has a cylindrical or spiral shape. The bearing surface can in particular be a part of the mandrel (it is then the cylindrical surface of the mandrel or an added surface, rigidly integral with the mandrel) or of the interior ferrule (each portion of ferrule then having a surface in the form of a portion of a cylinder or spiral, with the assembly of the different portions forming a continuous cylindrical or spiral surface, which is the bearing surface).

In accordance with the invention, a closed flange 40 is moreover attached to the arms 20*a*. The flange can, for example, be formed by cutting a metal sheet. The flange is thus planar. The flange preferably has a constant thickness.

The flange typically has a thickness between 10 and 40 mm, preferably between 10 and 25 mm.

Particularly advantageously, the flange is cut in the same sheet as the mandrel. It is thus sufficient to perform a cut (for example via laser) according to the external shape of the mandrel—which also coincides with the internal shape of the flange, and a cut according to the external shape of the flange, in order to form both the mandrel and the flange, without loss of material other than possible scraps corresponding to the sheet located outside the flange.

The mandrel and the flange can be formed from a stainless steel sheet. Alternatively, the mandrel and the flange can be formed from a steel sheet, then receive a protective treatment, for example by galvanisation or paint.

Figure 6:
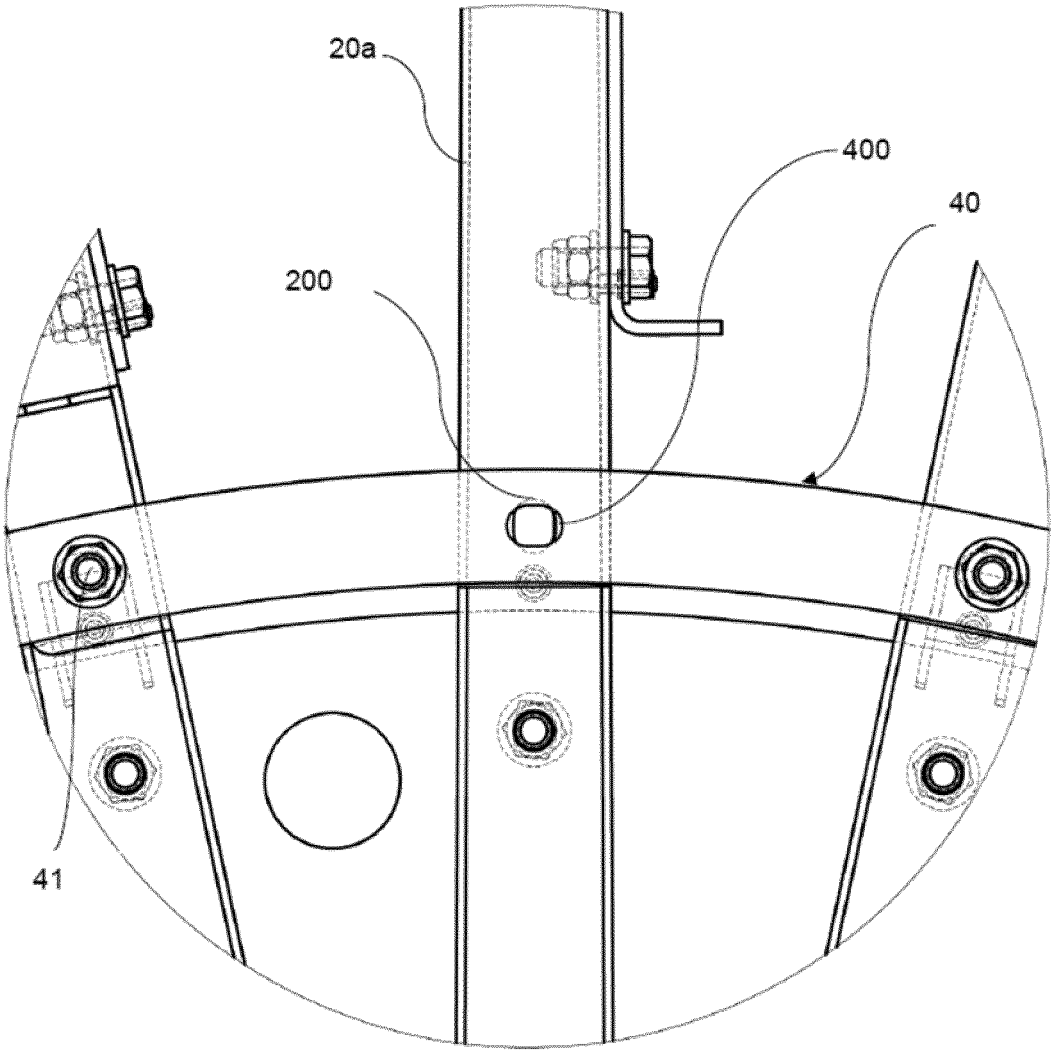
FIG. 6 is a detailed view of the reel of FIG. 4.

The flange is provided with orifices 400 for the passage of threaded rods or screws 41 required for the attaching of the flange on the arms. Likewise, each arm is provided, at the provided location for the flange, with an orifice 200 for the passage of said threaded rods or screws. Preferably, to take into account any dimensional dispersions, the orifices 200 and 400 are oblong. More preferably, as shown in FIG. 6, each oblong orifice 200 is oriented substantially perpendicularly to the corresponding oblong orifice 400, which makes it possible to absorb dimensional dispersions in two directions. Typically, the oblong orifices 200 extend along a tangent to a median circle of the flange, and the oblong orifices 400 extend in the direction of the length of the arms 20*a*.

The width of the flange is chosen large enough to allow for the passage of the threaded rods and to have adequate mechanical strength. Typically, the width of the flange is between 30 and 100 mm for an outer diameter of 1,000 to 3,000 mm. The width of the flange is preferably constant.

Such a flange, by connecting the arms of the same flank together, has a function of taking up the forces exerted on the arms, which has for effect to increase the rigidity of the reel and also to increase the stability thereof during the lifting thereof from the horizontal position (which is typically the position in which the reel is assembled) to the vertical position (which is the normal position of use of the reel). The flange thus acts as a reinforcement.

Thus, the presence of the flange makes it possible to reduce the thickness of the mandrel without penalising the rigidity of the reel, which procures a significant gain in mass and in cost of the reel. As this rigidification can be obtained with sheets of a relatively low thickness, in particular less than 25 mm, it allows for the use of methods of cutting with a laser.

EXAMPLE

The effect of the closed flange described hereinabove on the rigidity of the reel was verified using digital simulations.

The reel which is the subject of these simulations has a mandrel 20 mm thick. With respect to a known reel which mandrel has a thickness of 40 mm, this reel has a reduced mass, a lower cost, and makes it possible to wind a cable of low width, i.e. of about 20 mm.

The simulations aim to verify the resistance of the reel in response to a force of the wind. The force Fv of the wind exerted by the wind on the mandrel is defined by the formula:

$$F_v = \frac{1}{2}(\rho.\ S.\ C_x.\ V^2) \quad \text{[Math 1]}$$

where ρ is the density of the fluid, here, air; $\rho=1.28\ kg/m^3$, $C_x$ is the drag coefficient of the reel; $C_x$ is equal to 1.2, which is the drag coefficient of a disc, V is the speed of the wind (in m/s); in the simulation, a maximum speed of 70 m/s is tolerated, S is the surface of the link wound on the reel:

$$S = \frac{\pi}{4}(8^2 - 3.1^2) = 42.7\ m^2 \quad \text{[Math. 2]}$$

The following is obtained: Fv=160756 N

Figure 7A:
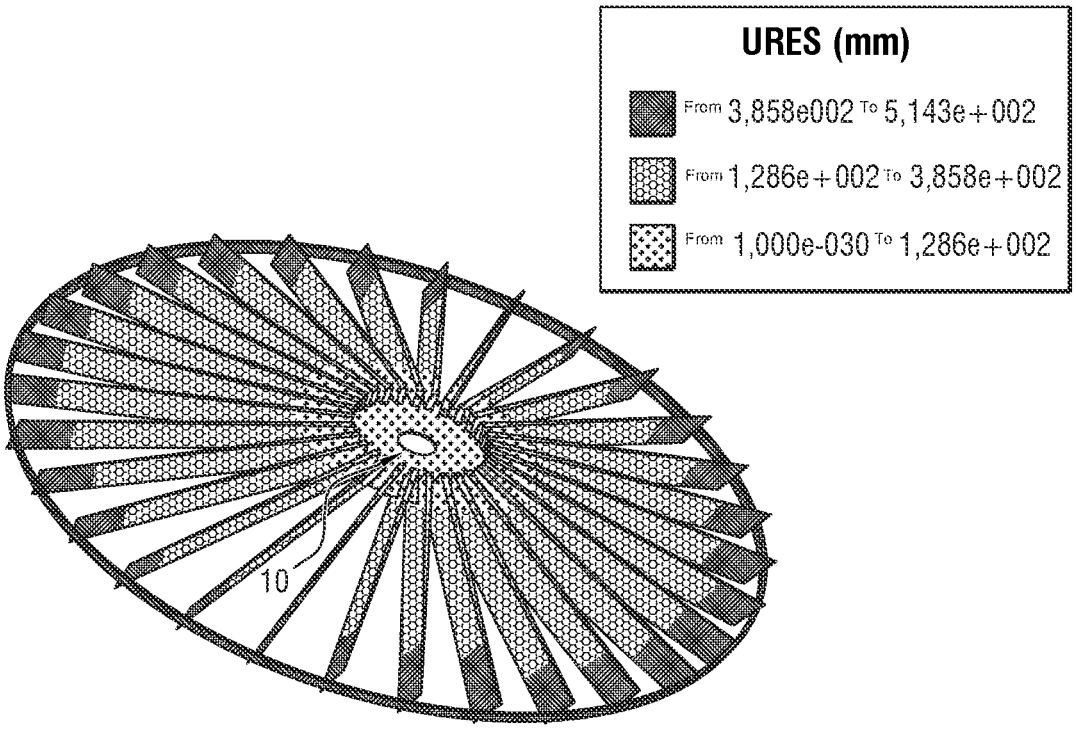
FIG. 7A shows the displacements (in mm) of the arms for a reel of a known type of which the thickness of the mandrel is 20 mm, calculated by a digital simulation.

This force is applied on all the arms and the maximum displacement at the exterior ferrule is calculated. The following is obtained:

for the reel with the mandrel of 40 mm, a maximum displacement of 60 mm, for the reel with the mandrel of 20 mm (without the flange), a maximum displacement of 508 mm (cf. FIG. 7A).

This shows that the reduction in the thickness of the mandrel has for effect to substantially increase the displacement of the distal end of the arms, which is detrimental to the mechanical strength of the reel and to the use thereof in particular under the effect of a strong wind.

Simulations are then carried out with a reel according to the invention. This reel comprises a mandrel 20 mm thick. The flange and the mandrel are cut in a same sheet of 2 m×2 m. In this simulation, the mandrel has a circular shape and the flange has an annular shape of which the inner shape coincides with the shape of the mandrel. The outer diameter of the mandrel is 1850 mm, corresponding to the inner diameter of the flange, and the outer diameter of the flange is 1975 mm.

Figure 7B:
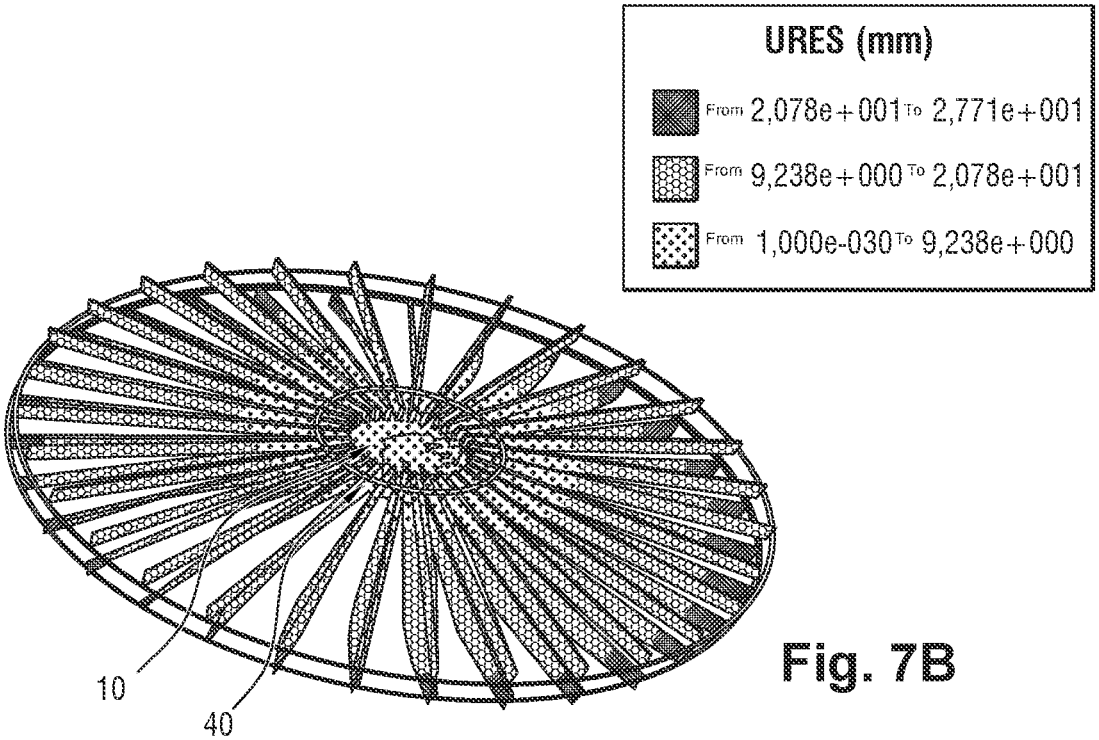
FIG. 7B shows the displacements (in mm) of the arms for a reel in accordance with the invention of which the thickness of the mandrel is 20 mm, calculated by a digital simulation.

Thanks to this reinforcing flange, the maximum displacement at the distal end of the arms under a wind of 70 m/s is 27 mm (cf. FIG. 7B), i.e. reduced by a factor of 18 with respect to the reel devoid of the flange.

REFERENCES

WO 2014/167105
WO 2015/071341

The invention claimed is:

1. A reel for the winding and unwinding of a link, comprising:

a mandrel extending around an axis of rotation of the reel; and a plurality of pairs of lateral arms extending on both sides of the mandrel, together acting as flanks defining between them a winding volume for the link, wherein said reel comprises a closed flange attached to the arms constituting one of said flanks, said closed flange having a thickness of between 10 and 40 mm, wherein the mandrel has a thickness of between 20 and 40 mm, and wherein the closed flange is attached to each arm constituting one of the flanks by threaded rods or screws, each threaded rod or screw passing through an oblong hole of the closed flange and an oblong hole of the respective arm, said oblong holes being oriented along substantially orthogonal directions.

2. The reel according to claim 1, wherein said closed flange has a thickness adapted to be cut by a laser.

3. The reel according to claim 1, wherein said closed flange has a thickness identical to that of the mandrel.

4. The reel according to claim 1, wherein an external shape of the mandrel coincides with an internal shape of the closed flange.

5. The reel according to claim 1, wherein the closed flange has a width between 30 and 100 mm.

6. The reel according to claim 1, wherein the closed flange has an annular shape.

7. A method for manufacturing a reel having a mandrel extending around an axis of rotation of the reel and a plurality of pairs of lateral arms extending on both sides of the mandrel, together acting as flanks defining between them a winding volume for the link, wherein said reel comprises a closed flange attached to the arms constituting one of said flanks, the method comprising:

supplying the mandrel and the closed flange;

attaching the lateral arms on both sides of the mandrel to form two flanks; and attaching the closed flange on the lateral arms constituting one of the flanks, the closed flange having a thickness of between 10 and 40 mm, the mandrel having a thickness of between 20 and 40 mm, wherein the closed flange is attached to each arm constituting one of the flanks by threaded rods or screws, each threaded rod or screw passing through an oblong hole of the closed flange and an oblong hole of the respective arm, said oblong holes being oriented along substantially orthogonal directions.

8. The method according to claim 7, wherein said closed flange has a thickness identical to that of the mandrel, wherein supplying the mandrel and the closed flange comprises cutting the mandrel and the closed flange from a same metal sheet, the closed flange extending around the mandrel.

9. The method according to claim 8, wherein cutting is carried out by a laser.

10. A reel for the winding and unwinding of a link, comprising:

a mandrel extending around an axis of rotation of the reel; and a plurality of pairs of lateral arms extending on both sides of the mandrel, together acting as flanks defining between them a winding volume for the link, wherein said reel comprises a closed flange attached to the arms constituting one of said flanks, said closed flange having a thickness of between 10 and 40 mm, wherein the mandrel has a thickness of between 20 and 40 mm, and wherein the closed flange is attached to each arm constituting one of the flanks by threaded rods or screws, each threaded rod or screw passing through an oblong hole of the closed flange and an oblong hole of the respective arm.

11. The reel according to claim 10, wherein said closed flange has a thickness adapted to be cut by a laser.

12. The reel according to claim 10, wherein said closed flange has a thickness identical to that of the mandrel.

13. The reel according to claim 10, wherein an external shape of the mandrel coincides with an internal shape of the closed flange.

14. The reel according to claim 10, wherein the closed flange has a width between 30 and 100 mm.

15. The reel according to claim 10, wherein the closed flange has an annular shape.

16. The reel according to claim 10, wherein the closed flange has a thickness identical to that of the mandrel.

* * * * *